United States Patent [19]

Bentz

[11] 4,066,237

[45] Jan. 3, 1978

[54] ADJUSTABLE FORM STAKE ASSEMBLY

[76] Inventor: Jack Bentz, 1904 N. 26th, Boise, Idaho 83702

[21] Appl. No.: 723,942

[22] Filed: Sept. 16, 1976

[51] Int. Cl.[2] ..... E01C 19/50

[52] U.S. Cl. ..... 249/213; 249/4; 249/208

[58] Field of Search ..... 249/2–9, 249/208, 190, 213, 210; 85/1 R

[56] References Cited

U.S. PATENT DOCUMENTS

| | | | |
|---|---|---|---|
| 1,067,420 | 7/1913 | Forbis | 249/9 |
| 1,172,406 | 2/1916 | Taylor | 85/1 R |
| 1,274,618 | 8/1918 | Smith | 249/3 |
| 2,635,320 | 4/1953 | Ornitz | 249/208 |
| 2,704,357 | 3/1955 | Johnson | 85/1 R |
| 3,228,679 | 1/1966 | Dees | 249/3 |
| 3,300,920 | 1/1967 | Skaare | 249/3 |
| 3,378,968 | 4/1968 | Shoemaker | 249/3 |
| 3,680,823 | 8/1972 | Lougheed | 249/3 |

*Primary Examiner*—Robert D. Baldwin
*Assistant Examiner*—John McQuade
*Attorney, Agent, or Firm*—Wells, St. John & Roberts

[57] ABSTRACT

A form stake assembly for adjustably holding a concrete form at a prescribed grade. It includes a pointed stake that has an elongated slot slidably receiving the shank of a carriage bolt. The headed end of the bolt abuts one side of the stake. The bolt shank receives a wing nut on the other side of the stake. The wing nut may be selectively tightened to clamp the bolt against the stake or loosened to enable sliding movement of the bolt within the confines of the longitudinal slot. The bolt includes a central bore extending through the shank and head to receive the shank of a nail. The nail is utilized to secure a concrete form member to the carriage bolt and wing nut assembly. A tie rod is included that may extend between opposed stakes on opposite sides of the form area. The tie rod includes a headed end and a free end. The headed end abuts one side of one stake while the shank extends through the slots of both stakes to receive a slidable collar. A set screw is provided on the collar to lock the collar in abutment with the associated stake and thereby hold the form members together against the weight of wet concrete received therebetween.

6 Claims, 6 Drawing Figures

ADJUSTABLE FORM STAKE ASSEMBLY

BACKGROUND OF THE INVENTION

The present invention is related to the field of concrete form supports and more particularly to such supports that are utilized to support elongated, narrow forms ordinarily used in forming concrete slabs, driveways, walkways, etc.

The conventional method of setting up forms for the pouring of concrete slabs, walkways, or other surfaces, usually involves the process of placing forms in position and holding them in the selected position by wooden stakes driven into the ground. These stakes are nailed directly to the form members (usually pieces of plywood or lumber). The principal problem encountered is in precisely locating the top of the forms at a preselected grade. This is a very difficult process, especially in limited space where only one man may attempt to hold the form member at the prescribed grade, pound a wooden stake into the ground adjacent the form member and hold the form member at grade level while nailing the stake and form member together. It is therefore very desirable to obtain some type of selectively adjustable support for the form members that may be conveniently utilized to set the forms at a prescribed grade without requiring excessive nailing and that will greatly improve the accuracy of placing forms at a precise grade level.

U.S. Pat. No. 1,274,618 to C. A. Smith granted Aug. 6, 1918 discloses a combined concrete form stake. Smith shows a relatively useful adjustable stake assembly wherein a slotted plate is affixed to a form member to receive the headed end of a locking member. The locking member is slidably received in a longitudinal slot of an upright pointed stake. The locking member may be selectively clamped against the stake to enable selective elevational positioning of the associated form member. This apparatus is serviceable when the form members are to be used repeatedly. However, the plate must be removed once the form members become unusable, or they must be discarded along with the form. Further, the permanency of the plates on the form members dictates the positioning of the stakes along the ground surface. This may be undesirable when the particular location of a plate turns out to be directly adjacent to an obstruction, i.e., a wall surface, tree trunk, etc.

U.S. Pat. No. 1,067,420 to F. H. Forbis, granted July 15, 1913, discloses a mold which includes provisions both for adjustably supporting a concrete form and for tieing opposed form support members together across the area to be poured with concrete. The stake members of this application are elongated and have two longitudinally spaced slots therein. A slot adjacent a point or bottom end of a stake receives a clamp member that holds the concrete form member securely to the stake. These members include a claw that projects from an outside surface of the form member to the inside surface. Thus, when the forms are removed, indentations are left in the concrete. The clamp members do facilitate elevational adjustment of the form members. This is accomplished by releasing the clamp members to slide in their associated slots, elevationally locating the form member, and then tightening the clamp members to secure the form member to the associated stake. This involves adjusting at least two clamp members per stake. Upper ends of the stakes include sleeves which slidably support an elongated tie rod. The tie rod is to extend between stakes on opposite sides of the form. Such tie rods are utilized to hold the stakes vertically under the pressure of poured concrete against the associated form members.

Additional stake and tie rod assemblies may be found in U.S. Pat. Nos. 3,680,823; 2,635,320; 3,228,697; 3,378,968; and 3,300,920.

The present invention was conceived to enable quick and efficient elevational positioning of form members and further to provide a reusable adjustable form support assembly that may be easily and quickly removed from the form members or may be left in place on the form members for reuse. The present invention includes a vertically slotted stake that slidably receives a carriage bolt. A wing nut is threadably engaged with the shank of the carriage bolt to selectively clamp the carriage bolt against the stake. A bore is provided through the length of the carriage bolt to receive the shank of a nail therein. This nail provides support to a form member, located with its side in abutment with the headed end of the carriage bolt. Through this connection, the form member becomes elevationally moveable along the length of the slotted portion of the stake. If conventional double-headed nails are utilized in connecting the carriage bolt and form member, removal of the form member is easily and quickly accomplished. However, the stake may be left in place against the form member and folded into longitudinal parallel relation with the length of the member to facilitate storage. In addition, an adjustable tie member may be utilized to connect the slotted stakes on opposite sides of a form area. The tie rod includes a headed end that is received through an enlarged opening at an upper end of the slotted portion of one stake. A shank of the tie rod extends to the opposite side of the form area to protrude through the slotted portion of an opposed stake. A slidable collar is received on the shank to abut an outwardly facing surface of the opposite stake. The collar may be selectively locked in place by a set screw to firmly hold the stakes in an upright position.

SUMMARY OF THE INVENTION

An adjustable form stake is described to enable selective leveling of concrete form members to a prescribed grade and for holding the form members at the prescribed grade. The stake is elongated with a point at a lower end with a striking surface at an upper end. An elongated slot is formed through the stake which extends longitudinally from an upper slot end adjacent the striking surface to a lower slot end upwardly spaced from the point. A headed carriage bolt is slidably received within the slot. The carriage bolt includes a headed end that is of larger dimension then the width of the slot. The bolt also includes a threaded shank that is slidably received by and projects through the slot to a free end outwardly adjacent to the stake. An open bore extends through the carriage bolt from the free shank end to the headed end. The bore is adapted to receive the shank of a nail. A nut is threadably engaged with the threaded shank to selectively clamp the carriage bolt securely to the stake. An elongated tie rod may also be provided that includes a headed end of dimension larger than the width of the stake slot. The tie rod also includes an elongated shank of smaller cross-sectional dimension than the stake slot. It may therefore connect opposed stake assemblies together with the headed rod end engaged against one stake and the shank protruding through the slot of the opposed stake. A collar is slidably received on the tie rod shank that is of larger dimension than the slot width. A set screw on the collar enables selective positioning of the collar along the length of the tie rod shank against one side of the opposed stake in order that the two stakes be held relatively together across a form area.

It is an object of the present invention to provide an adjustable form support assembly that will easily and quickly enable setting of a form to a precise grade without requiring that the stake and form member be permanently secured by nails when the precise grade is achieved.

Another object is to provide such an adjustable form support assembly that includes few moving parts that need not be disassembled when the stake is being attached to or removed from a form member.

An additional object is to provide such an assembly that may be easily and quickly attached and removed from a form member since only a single nail is used.

A still further object is to provide such a form support that is entirely adjustable with all adjusting and clamping elements located to the outside of the form member such that unnecessary imprints will not be made in the poured concrete.

A still further object is to provide such an adjustable form support assembly that may be secured to the form member prior to location of the form member at a selected area, thus enabling the form to be situated along a desired line before the stake is driven into the ground to secure the form member along the prescribed line.

A still further object is to provide such an assembly wherein a tie rod may be removably used with opposed stake assemblies on opposite sides of a form area and wherein the tie rod may be situated above the grade level of the poured surface to facilitate ease in pouring and trowelling of the concrete surface.

These and other important objects and distinct advantages will become apparent upon reading the following detailed description, which, taken with the accompanying drawings, describe a preferred form of my invention. It is to be noted that the drawings and following specification are not to be taken as restrictions upon the scope of my invention. Such restrictions are defined only by the claims found at the end of this specification.

DETAILED DESCRIPTION OF A PREFERRED EMBODIMENT

Figure 1:
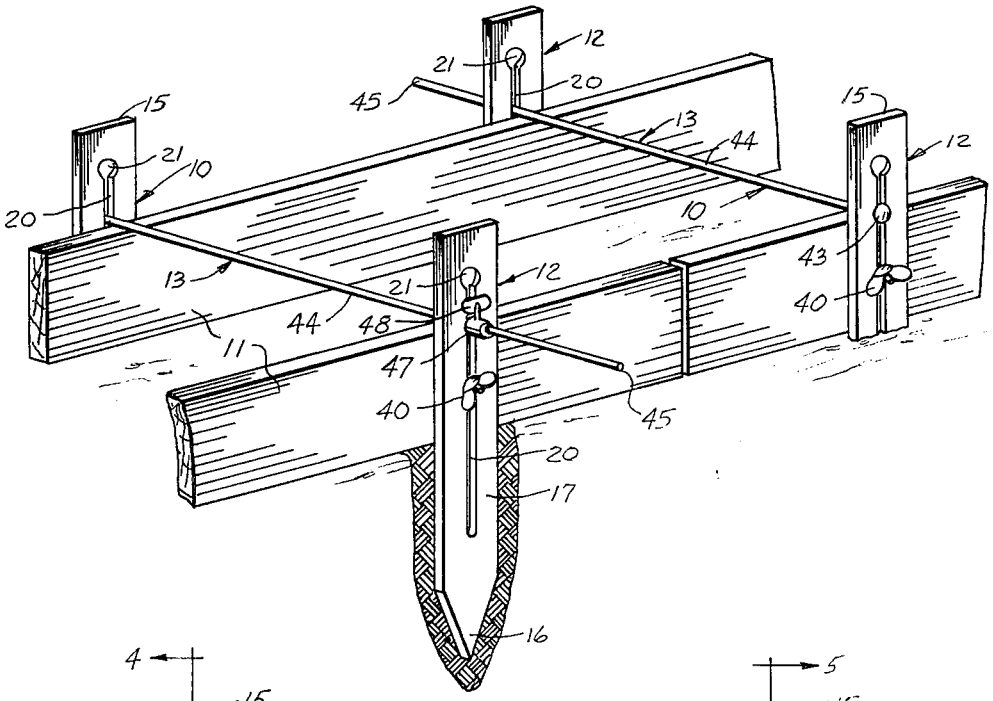
FIG. 1 is a fragmentary pictorial view of two complete form support assemblies in operation.
Figure 2:
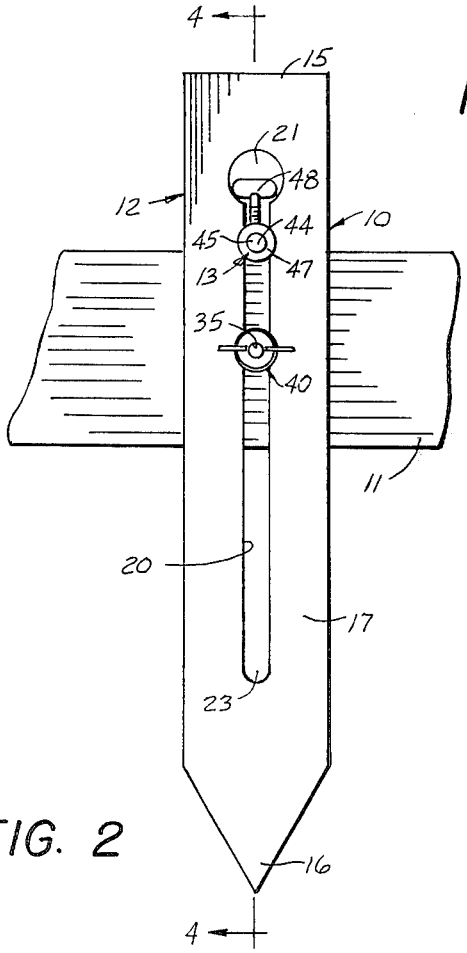
FIG. 2 is a detailed elevational view of a stake assembly on one side of the form area shown in FIG. 1.
Figure 3:
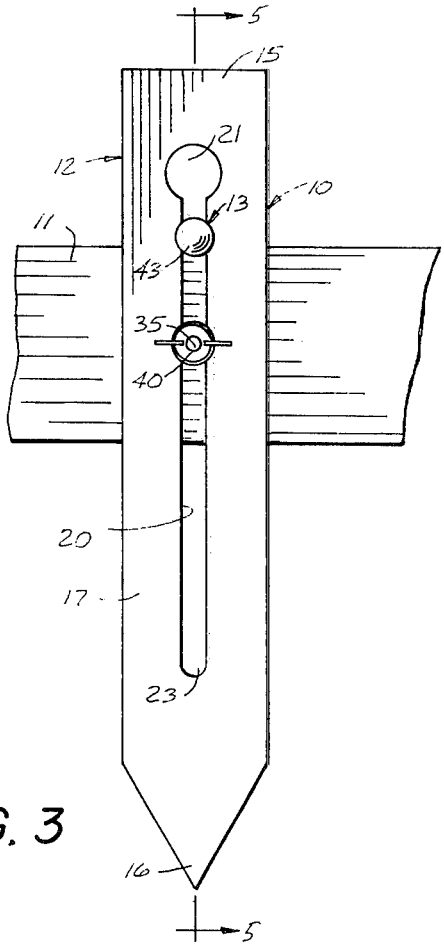
FIG. 3 is a view similar to FIG. 2 only showing a stake assembly on the opposite side of the form area.

A preferred form of the present form support assembly is shown in the accompanying drawings and is generally designated therein by the reference character 10. It is the purpose of the present assembly 10 to adjustably support concrete forms such as those shown at 11 at a prescribed grade. Basically, the present assembly 10 includes adjustable form support stakes such as those shown at 12 in FIG. 1 that may be used independently or in conjunction with interconnecting tie rods 13.

The stakes are shown in particular detail by FIGS. 2 through 6. Each stake 12 includes a top striking surface 15. The stakes are elongated and extend from the top striking surface 15 to a lower end having a point 16. The stakes are rectangular in cross section having opposed planar sides 17. They are formed of steel with the pointed ends tempered to resist wear and breakage.

Each stake 12 includes an elongated slot 20 that extends from an enlarged opening 21 at an upper slot end to a lower slot end 23 that is upwardly spaced from the point 16.

A carriage bolt 27 is slidably carried within the slot 20. It includes an enlarged headed end 28 and a threaded shank 29 extending therefrom. The shank 29 terminates in a free end 30 (FIG. 6) that projects outwardly adjacent to one planar side 17 of an associated stake. Shank 29 also includes a rectangular unthreaded portion 31 that is complementary to but slightly smaller in dimension than the width of the slot 20. The "slot width" is to be understood as the dimension across the slot 20 on a plane perpendicular to the length of the stake.

The carriage bolt 27 includes an open bore 32 extending from the free end 30 of shank 29 to the headed end 28. The bore is adapted to receive the shank portion of a nail such as that shown at 35.

A wing nut 40 threadably engages the threaded shank 29 on one side 17 of the associated stake 12. The headed bolt end 28 engages the opposite stake side 17. Since the headed end 28 is of a dimension larger than the slot width, and the wing nut 40 is also of such dimension, the bolt and nut may be selectively clamped through the slot against the opposite sides 17 of the stake. Further, by loosening the wing nut, the bolt may be loosened to slide freely along the full length of the slot 20.

The rectangular portion 31 is of only slightly smaller dimension than the slot width. It therefore prevents rotational movement of the bolt shank 29 in response to turning force applied to the wing nut 40. One or more washers 41 may be provided, one preferably being a form of lock washer to assure a firm grip between the carriage bolt and stake 12.

Figure 4:
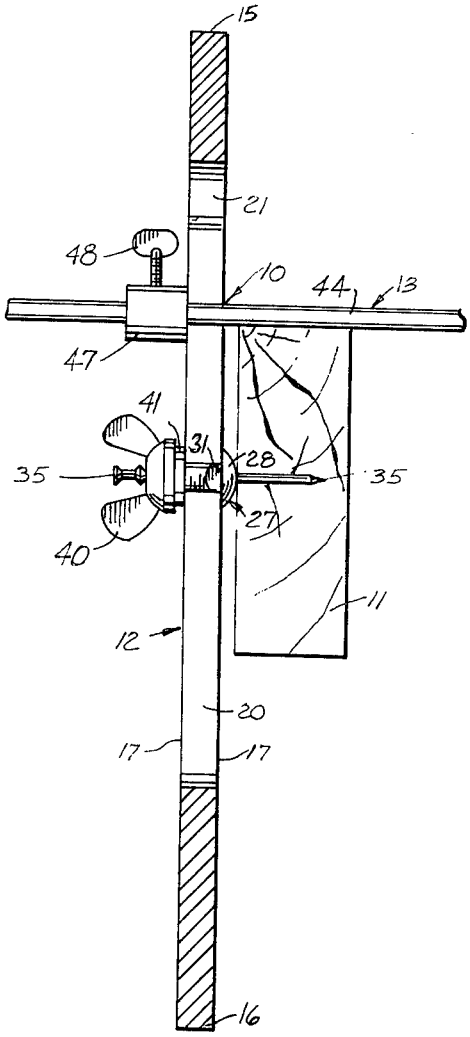
FIG. 4 is a sectional view taken along line 4—4 in FIG. 2.
Figure 5:
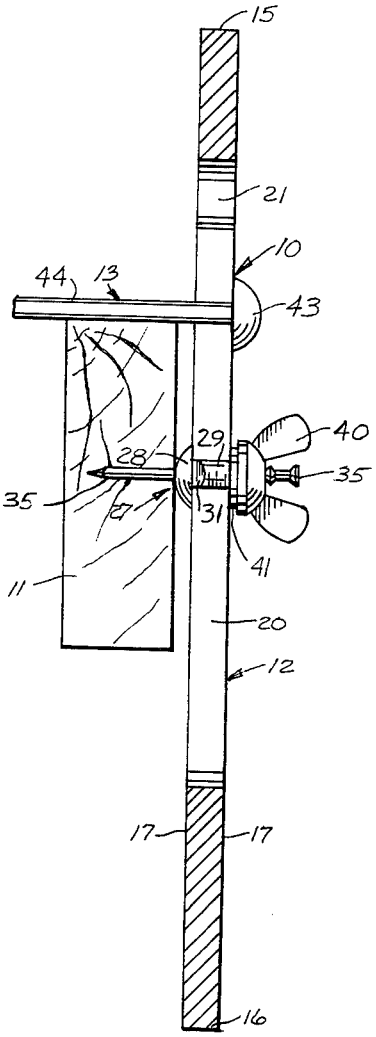
FIG. 5 is a sectional view taken along line 5—5 in FIG. 3.
Figure 6:
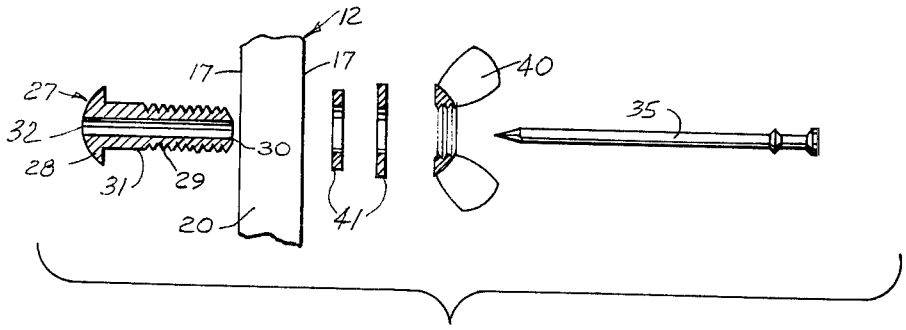
FIG. 6 is an exploded sectioned view of a portion of the present assembly.

It may be noted in FIGS. 4 and 5 that the length of the bolt shank 29 is selected so that no threaded portion of the shank is exposed outward of the wing nut 40 when engaged on a stake 12. This provision assures that the threaded shank will remain clean during pouring of concrete between form members.

The elongated tie rod 13 is utilized to hold opposed stakes 12 in an upright condition against outward forces applied by wet concrete against the sides of the form members 11. The tie rod includes a headed end 43 and an elongated shank 44. The shank terminates at a free end 45. A slidable collar 47 is movably received on the shank 44 and may be set at selected positions by a set screw 48.

The headed end 43 of tie rod 13 is larger than the width of the slots 20 but smaller than the enlarged openings 21. It may therefore be selectively engaged or removed from the opposed stakes from either side of the form area.

In operation the tie rod is placed between opposed stakes that are aligned with one another across a form area as shown in FIG. 1. The headed tie rod end 43 is engaged on one side 17 of one stake while the shank 44 extends across the form to be received through the slot 20 of the opposed stake. The collar 47 engages the outwardly facing surface or side 17 of the opposite stake and is secured in place by the set screw 48. The tie rod will thereby hold the stakes in an upright condition against the outward forces of the concrete that are applied directly to the form members.

From the above description, varied uses and operations of the present invention may be easily understood.

FIG. 1 illustrates a completed arrangement wherein form members 11 have been secured in position and set to a prescribed grade level by the present assembly 10. It is noted that several assemblies may be utilized in spaced relation along the length or across the width of a specified form area.

In securing the form members 11 in place, the stakes 12 are first driven into the ground along a prescribed line. This line may be determined by a string line connected between two stakes driven at opposite ends of the area to be poured. The stakes 12 are driven into the ground in an upright condition at selected positions along the length of the string line with the headed bolt ends 28 facing inwardly. Form members may then be situated along the inwardly facing surfaces of the driven stakes and attached to the stake assemblies by nailing through the open bore 32 of carriage bolt 27. Once this has been accomplished, the wing nuts 40 may be selectively utilized to enable elevational positioning of the form member to a prescribed grade level.

Once the prescribed elevation has been selected, the wing nuts are tightened and the form is thereby secured at the selected grade. A tie rod 13 may then be connected across the form area to secure opposed stake members together. This prevents the stakes from leaning outwardly in response to the considerable outward pressure applied by the wet concrete.

The tie rods may be located within the slots 20 elevationally above the upper surfaces of the form members to enable troweling of the concrete surface. The rods are of relatively small cross-sectional diameter and will not interfere with the pouring procedure by deflecting concrete outwardly onto the outside surfaces of the forms or stakes.

Once the assemblies have been firmly anchored into position by tightening wing nuts 40 and set screws 48, the forms are held securely in place and the form area between members 11 may be poured full of concrete.

The forms may be stripped from the hardened concrete monolith after the concrete has been troweled and has set. Firstly before stripping, the tie rods are removed from engagement with the opposed stake assemblies. The next step is to either pull the nails 35 to disengage the stakes from the form members or to leave the nails in place and simply loosen the wing nuts 40 and pull the stakes upwardly relative to the form members. If the nails are left in place and the stakes are pulled, the form may be stripped from the concrete and reused with the support stake assemblies still in place. In this situation, the stakes may be turned so that their lengths are parallel to the form lengths. They are then fastened in this position by tightening the wing nuts, clamping the stakes in position. A separate nail (not shown) can be driven into the form through slot 20 to prevent the stake 12 from turning about nail 35.

If the stakes are to be removed from the form members, the nails 35 are pulled and the detached stake assemblies are then pulled from the ground and stored separately of the form members 11. The form members may be easily stripped from the hardened concrete after removal of the stakes.

It is again to be understood that the above description has been given only by way of example and that other embodiments thereof may be envisioned. It is further understood that there are many and varied manners by which the present invention may be utilized in the process of setting concrete forms. It is therefore intended that only the following claims be taken as limitations on my invention.

I claim:

1. An adjustable form support stake assembly, comprising:

an elongated stake having opposed sides and a point at a lower end and a striking surface at an upper end;

an elongated slot formed through the stake and extending longitudinally therein from an upper slot end adjacent the striking surface to a lower slot end upwardly spaced from the stake point;

a carriage bolt having a headed end of larger dimension than the width of the slot for abutment with one side of the stake and a threaded shank slidably received by and projecting through the slot to a free end outwardly adjacent to the stake;

open bore means extending through the carriage bolt from the free shank end to the headed end for receiving the shank of a nail; and a nut threadably mounted to the free end of the threaded shank for abutment with the remaining side of the stake to selectively clamp the carriage bolt securely to the stake.

2. The stake assembly as defined by claim 1 further including an enlarged opening at the upper end of the slot adapted to receive a tie rod.

3. The stake assembly as defined by claim 1 wherein the stake is rectangular in cross section and wherein the carriage bolt includes a rectangular portion along the shank that is complementary to the elongated slot.

4. An adjustable form support stake assembly, comprising:

a pair of elongated stakes each having opposed sides and a point at a lower end and a striking surface at an upper end;

an elongated slot formed through each stake and extending longitudinally therein from an upper slot end adjacent the striking surface to a lower slot end upwardly spaced from the point;

a pair of carriage bolts having headed ends of larger dimension than the widths of the slots for abutment with one side of a stake and threaded shanks slidably received within the respective slots and projecting through the slots to free ends outwardly adjacent the respective stakes;

open bore means extending through each carriage bolt from the free shank end to the headed end for receiving the shank of a nail;

a nut threadably mounted to each free end of the threaded shanks for abutment with the remaining side of a stake to selectively clamp the respective carriage bolts securely to their associated stakes;

an elongated tie rod having a headed end of dimension larger than the width of the stake slots and an elongated shank of smaller cross-sectional dimension than the stake slots, said tie rod connecting the stakes together with the headed rod end thereof engaged against one stake and with the shank of the tie rod protruding through the slots of the two stakes;

a collar having a radial dimension larger than the stake slot width, said collar being slidably received on the tie rod shank in engagement with the remaining stake; and a set screw threadably mounted by the collar, adapted to engage the shank of the tie rod to selectively lock the collar on the tie rod shank in abutment with said remaining stake.

5. The stake assembly as defined by claim 4 further comprising an enlarged opening at the upper end of each stake slot adapted to receive the headed end of the tie rod therethrough.

6. The stake assembly as recited by claim 4 wherein the stakes are rectangular in cross section and wherein the carriage bolts each include a rectangular portion along its shank that is complementary to the associated elongated slot.

* * * * *